US006788325B2

(12) United States Patent
Miller

(10) Patent No.: US 6,788,325 B2
(45) Date of Patent: Sep. 7, 2004

(54) PROCESSING MULTIPLE THERMAL ELEMENTS WITH A FAST ALGORITHM USING DOT HISTORY

(75) Inventor: John R. Miller, Richfield, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 106 days.

(21) Appl. No.: 09/683,720

(22) Filed: Feb. 6, 2002

(65) Prior Publication Data

US 2003/0146967 A1 Aug. 7, 2003

(51) Int. Cl.[7] ..... B41J 2/36
(52) U.S. Cl. ..... 347/191
(58) Field of Search ..... 347/180–182, 347/190–191, 194–196; 400/120.05, 120.06, 120.1, 120.11, 120.14, 120.15

(56) References Cited

U.S. PATENT DOCUMENTS

| | | | | |
|---|---|---|---|---|
| 4,567,488 A | | 1/1986 | Moriguchi et al. | 346/76 |
| 5,038,154 A | * | 8/1991 | Yamamoto et al. | 347/180 |
| 5,548,688 A | | 8/1996 | Wiklof et al. | 395/108 |
| 5,559,547 A | | 9/1996 | Hagar | 347/211 |
| 5,625,399 A | | 4/1997 | Wiklof et al. | 347/195 |
| 5,793,403 A | | 8/1998 | Klinefelter | 347/195 |
| 6,008,831 A | | 12/1999 | Nakanishi et al. | 347/195 |
| 6,034,705 A | | 3/2000 | Tolle et al. | 347/195 |
| 6,219,153 B1 | | 4/2001 | Kawanabe et al. | 358/1.16 |
| 6,249,299 B1 | | 6/2001 | Tainer | 347/191 |
| 6,404,452 B1 | * | 6/2002 | Spano | 347/195 |

FOREIGN PATENT DOCUMENTS

| | | | |
|---|---|---|---|
| JP | 61116555 | 6/1986 | B41J/3/20 |
| JP | 4305471 | 10/1992 | B41J/2/36 |

* cited by examiner

*Primary Examiner*—K. Feggins
(74) *Attorney, Agent, or Firm*—Whyte Hirschboeck Dudek SC

(57) ABSTRACT

A method of accessing stored printing parameters from a memory associated with a specific supply and simultaneously processing a group of thermal elements. The thermal element group generally comprises consecutive thermal elements. The processor concurrently considers the thermal element group and the dot history of thermal element group. The method of simultaneously processing the thermal element group comprises packing the thermal element group into a dot history pattern and forming a multiple thermal element organizational table. Thereafter, the multiple thermal element organizational table is used by the processor to determine and regulate energy delivered to each thermal element in the thermal element group. Furthermore, by simultaneously processing the thermal element group, processor efficiency can be elevated. Thus, the method permits a printer to increase printing speed and reduces the workload of the processor associated with the printer.

28 Claims, 11 Drawing Sheets

36 36

MICROSTROBE ENERGY VALUES

| S1 | S2 | S3 | S4 | S5 |
|---|---|---|---|---|
| 1,000 | 5,000 | 5,000 | 4,000 | 19,000 |

54 54

FIG. 8

30 36 36

MICROSTROBES

| INDEX | S1 | S2 | S3 | S4 | S5 | STROBE NUMBER |
|---|---|---|---|---|---|---|
| 0 | 1 | 1 | 1 | 1 | 1 | 31 |
| 1 | 0 | 1 | 1 | 1 | 1 | 30 |
| 2 | 0 | 1 | 1 | 1 | 1 | 30 |
| 3 | 0 | 0 | 1 | 1 | 1 | 28 |
| 4 | 0 | 1 | 1 | 1 | 1 | 30 |
| 5 | 0 | 0 | 1 | 1 | 1 | 28 |
| 6 | 0 | 0 | 1 | 1 | 1 | 30 |
| 7 | 0 | 0 | 1 | 1 | 1 | 28 |
| 8 | 1 | 1 | 1 | 1 | 1 | 31 |
| 9 | 0 | 1 | 1 | 1 | 1 | 30 |
| 10 | 0 | 1 | 1 | 1 | 1 | 30 |
| 11 | 0 | 0 | 1 | 1 | 1 | 28 |
| 12 | 0 | 0 | 1 | 1 | 1 | 28 |
| 13 | 0 | 0 | 0 | 1 | 1 | 24 |
| 14 | 0 | 0 | 0 | 1 | 1 | 24 |
| 15 | 0 | 0 | 0 | 0 | 1 | 16 |

32 34 34 38 38 56 56

FIG. 9

60

| PACKED INDEX | DIVIDED MICROSTROBES | | | | | | | | | | | | | | | | | | | | PACKED STROBE NUMBER | | | |
|---|---|---|---|---|---|---|---|---|---|---|---|---|---|---|---|---|---|---|---|---|---|---|---|---|
| | S1 (W) | S1 (X) | S1 (Y) | S1 (Z) | S2 (W) | S2 (X) | S2 (Y) | S2 (Z) | S3 (W) | S3 (X) | S3 (Y) | S3 (Z) | S4 (W) | S4 (X) | S4 (Y) | S4 (Z) | S5 (W) | S5 (X) | S5 (Y) | S5 (Z) | (W) | (X) | (Y) | (Z) |
| 0 | 0 | 0 | 0 | 0 | 0 | 0 | 0 | 0 | 0 | 0 | 0 | 0 | 0 | 0 | 0 | 0 | 0 | 0 | 0 | 0 | | | | |
| 1 | 0 | 0 | 0 | 0 | 0 | 0 | 0 | 0 | 0 | 0 | 0 | 0 | 0 | 0 | 0 | 0 | 0 | 0 | 0 | 0 | | | | |
| 2 | 0 | 0 | 0 | 1 | 0 | 0 | 0 | 1 | 0 | 0 | 0 | 1 | 0 | 0 | 0 | 1 | 0 | 0 | 0 | 1 | | | | |
| 3 | 0 | 0 | 0 | 0 | 0 | 0 | 0 | 1 | 0 | 0 | 0 | 1 | 0 | 0 | 0 | 1 | 0 | 0 | 0 | 1 | | | | |
| 4 | 0 | 0 | 1 | 0 | 0 | 0 | 1 | 0 | 0 | 0 | 1 | 0 | 0 | 0 | 1 | 0 | 0 | 0 | 1 | 0 | | | | |
| 5 | 0 | 0 | 1 | 0 | 0 | 0 | 1 | 0 | 0 | 0 | 1 | 0 | 0 | 0 | 1 | 0 | 0 | 0 | 1 | 0 | | | | |
| 6 | 0 | 0 | 0 | 0 | 0 | 0 | 1 | 1 | 0 | 0 | 1 | 1 | 0 | 0 | 1 | 1 | 0 | 0 | 1 | 1 | | | | |
| 7 | 0 | 0 | 0 | 0 | 0 | 0 | 1 | 0 | 0 | 0 | 1 | 1 | 0 | 0 | 1 | 1 | 0 | 0 | 1 | 1 | | | | |
| 16,378 | 0 | 0 | 0 | 0 | 0 | 0 | 0 | 0 | 0 | 0 | 0 | 1 | 0 | 1 | 0 | 1 | 1 | 1 | 0 | 1 | | | | |
| 16,379 | 0 | 0 | 0 | 0 | 0 | 0 | 0 | 0 | 0 | 0 | 0 | 0 | 0 | 1 | 0 | 1 | 1 | 1 | 0 | 1 | | | | |
| 16,380 | 0 | 0 | 0 | 0 | 0 | 0 | 0 | 0 | 0 | 0 | 0 | 0 | 0 | 0 | 1 | 0 | 1 | 1 | 1 | 0 | | | | |
| 16,381 | 0 | 0 | 0 | 0 | 0 | 0 | 0 | 0 | 0 | 0 | 0 | 0 | 0 | 0 | 1 | 0 | 1 | 1 | 1 | 0 | | | | |
| 16,382 | 0 | 0 | 0 | 0 | 0 | 0 | 0 | 0 | 0 | 0 | 0 | 0 | 0 | 0 | 0 | 1 | 1 | 1 | 1 | 1 | | | | |
| 16,383 | 0 | 0 | 0 | 0 | 0 | 0 | 0 | 0 | 0 | 0 | 0 | 0 | 0 | 0 | 0 | 0 | 1 | 1 | 1 | 1 | | | | |

74 74 74

62 64 64 64

FIG. 13

62

| PACKED INDEX | DIVIDED MICROSTROBES (72) | | | | | | | | | | | | | | | | | | | | PACKED STROBE NUMBER | | | |
|---|---|---|---|---|---|---|---|---|---|---|---|---|---|---|---|---|---|---|---|---|---|---|---|---|
| | S1 (W) | S1 (X) | S1 (Y) | S1 (Z) | S2 (W) | S2 (X) | S2 (Y) | S2 (Z) | S3 (W) | S3 (X) | S3 (Y) | S3 (Z) | S4 (W) | S4 (X) | S4 (Y) | S4 (Z) | S5 (W) | S5 (X) | S5 (Y) | S5 (Z) | (W) | (X) | (Y) | (Z) |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 64 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | 0 | 0 | 0 | 1 | 0 | 0 | 0 | 1 | 0 | 0 | 0 | 1 | 0 | 0 | 0 | 1 | 0 | 0 | 0 | 1 | 0 | 0 | 0 | 31 |
| 3 | 0 | 0 | 0 | 0 | 0 | 0 | 0 | 1 | 0 | 0 | 0 | 1 | 0 | 0 | 0 | 1 | 0 | 0 | 0 | 1 | 0 | 0 | 0 | 30 |
| 4 | 0 | 0 | 1 | 0 | 0 | 0 | 1 | 0 | 0 | 0 | 1 | 0 | 0 | 0 | 1 | 0 | 0 | 0 | 1 | 0 | 0 | 0 | 31 | 0 |
| 5 | 0 | 0 | 1 | 0 | 0 | 0 | 1 | 0 | 0 | 0 | 1 | 0 | 0 | 0 | 1 | 0 | 0 | 0 | 1 | 0 | 0 | 0 | 31 | 0 |
| 64 6 | 0 | 0 | 0 | 0 | 0 | 0 | 1 | 1 | 0 | 0 | 1 | 1 | 0 | 0 | 1 | 1 | 0 | 0 | 1 | 1 | 0 | 0 | 30 | 30 |
| 7 | 0 | 0 | 0 | 0 | 0 | 0 | 1 | 0 | 0 | 0 | 1 | 1 | 0 | 0 | 1 | 1 | 0 | 0 | 1 | 1 | 0 | 0 | 30 | 28 |
| 16,378 | 0 | 0 | 0 | 0 | 0 | 0 | 0 | 0 | 0 | 0 | 0 | 1 | 0 | 1 | 0 | 1 | 1 | 1 | 0 | 1 | 16 | 24 | 0 | 28 |
| 16,379 | 0 | 0 | 0 | 0 | 0 | 0 | 0 | 0 | 0 | 0 | 0 | 0 | 0 | 1 | 0 | 1 | 1 | 1 | 0 | 1 | 16 | 24 | 0 | 24 |
| 16,380 | 0 | 0 | 0 | 0 | 0 | 0 | 0 | 0 | 0 | 0 | 0 | 0 | 0 | 0 | 1 | 0 | 1 | 1 | 1 | 0 | 16 | 16 | 24 | 0 |
| 16,381 | 0 | 0 | 0 | 0 | 0 | 0 | 0 | 0 | 0 | 0 | 0 | 0 | 0 | 0 | 1 | 0 | 1 | 1 | 1 | 0 | 16 | 16 | 24 | 0 |
| 64 16,382 | 0 | 0 | 0 | 0 | 0 | 0 | 0 | 0 | 0 | 0 | 0 | 0 | 0 | 0 | 0 | 1 | 1 | 1 | 1 | 1 | 16 | 16 | 16 | 24 |
| 16,383 | 0 | 0 | 0 | 0 | 0 | 0 | 0 | 0 | 0 | 0 | 0 | 0 | 0 | 0 | 0 | 0 | 1 | 1 | 1 | 1 | 16 | 16 | 16 | 16 |

76

74

FIG. 14

PROCESSING MULTIPLE THERMAL ELEMENTS WITH A FAST ALGORITHM USING DOT HISTORY

FIELD OF THE INVENTION

The present invention relates generally to methods of simultaneously processing a group of thermal elements. In one aspect, the invention relates to methods of simultaneously processing a group of multiple thermal elements, using dot history and supply specific printing parameters, to generate a printed image.

BACKGROUND OF THE INVENTION

A typical thermal printer includes a printhead comprising a linear array of thermal elements. The number of thermal elements in the linear array can vary, with a characteristic printhead employing 1248 thermal elements. Each of the thermal elements produces heat in response to energy supplied by a microcontroller associated with the thermal printer. The microcontroller applies a voltage or current to each of the thermal elements to heat the thermal elements to a level sufficient to transfer dots (i.e., burns, printed dots, etc.) onto a media (e.g., an adhesive-backed substrate with an opposing ink-receiving surface). This is accomplished when a thermally-sensitive supply (e.g., ink-bearing ribbon, donor ribbon, etc.) comes into thermal contact with the thermal elements while proximate the media. Each thermal element can transfer a dot, or leave an unprinted area, depending on the amount of energy supplied to the thermal element.

Color printing is made possible by using a colored thermally-sensitive supply (e.g., a supply that contains colored ink). When the thermal element comes into thermal contact with the colored supply, a colored dot is generated. The range of colors available to the printer can be expanded if an additional, differently-colored dot is generated upon a first colored dot, such that the two colored dots combine to make a third color. This process of laying one dot over another can be repeated to produce a myriad of colors and/or shades of color.

As thermal elements in the linear array are selectively, intermittently fired, a raster line of dots and/or unprinted areas is produced. The media is stepped past the array of thermal elements in a direction transverse to the array of thermal elements such that consecutive raster lines are produced on the media. The raster line most recently printed is known as the current raster line, the raster line printed one generation earlier is known as the previous raster line, and the raster line printed two generations earlier is known as the two-back raster line. The patterns of dots produced within each raster line are known as burn patterns. These burn patterns can comprise all, or a portion of, the dots in the raster line. Thus, the current raster line produces current burn patterns, the previous raster line produces previous burn patterns, and so on, through the burn pattern generations to create a history of burn patterns within the raster lines (history is referred to in greater detail below).

While the temperature of a thermal element can be quickly raised by the application of energy, a longer time is required for the thermal element to cool, generally along an exponential curve that is affected by the ambient temperature of the printhead. This result occurs because a thermal element will retain heat and/or receive heat radiated from adjacent thermal elements. Thus, the thermal element will remain hot long after energy is directed to that thermal element. One problem with the thermal element remaining hot arises when the thermal element is instructed to remain idle (i.e., insufficiently heated), meaning that an area on the media remains unprinted. If the thermal element is too hot, a dot, or portion thereof, may be generated where no dot is desired.

The dilemma of excess retained or radiated heat predominately occurs after a series of consecutive dots are generated. For example, where a series of dots are produced by a thermal element at four consecutive sites on a media, and then the thermal element is instructed to remain idle at a fifth site, a dot might nonetheless be printed at the fifth site. This can occur if too much heat was retained by the thermal element after generating the first four dots because the thermal element remains above the temperature required to generate a dot when the thermal element reached the fifth site. In other words, the thermal element did not have sufficient time to cool below the temperature required to transfer a dot. Unfortunately, the normal consequence of the above example is a series of four dots followed by a fractional dot where there should be a blank, clear, or unprinted area. This problem is sometimes referred to in the art as hysteresis. Complicating the problem of hysteresis is the increasing printing speed being employed in printers. As the speed of printing increases, the media travels past the printhead faster and thermal elements have less time to cool.

Several approaches have been suggested to combat the problem of hysteresis. One such approach provides a plurality of thermal energy pulses of varying duration depending on whether a thermal element is "cold", "warm" or "hot". Another solution that has been suggested requires that all thermal elements be kept at an elevated resting temperature just below that needed for printing by supplying "maintenance" pulses during every interval that a thermal element is not actually printing. Yet, another solution to the problem employs dot history which takes into account the history of thermal element burn patterns in order to print more efficiently. In the simplest terms, dot history takes into account the firing, over time, of a thermal element and/or an adjacent thermal element or elements. Unfortunately, undertaking any of the above methods requires onerous calculations to be performed by the processor in the printer system. Part of the problem stems from the fact that each specific supply used in the printing system possesses different characteristics (e.g., width, ink color, ink type, etc.) that must be considered to produce a quality print. Thus, a printer processor is required to make numerous calculations, usually during the printing operation, for each new supply used.

In U.S. Pat. No. 6,034,705 to Tolle, et. al., and again in U.S. Pat. No. 6,249,299 to Tainer, methods of controlling energy supplied to a single thermal element based on dot history are disclosed. Also, In U.S. Pat. No. 5,548,688 to Wiklof, et. al., another method of controlling the energy supplied to a single thermal element based on dot history and adjacent thermal elements is disclosed. Wiklof also discloses determining the printing activity, namely whether the thermal element is energized or not energized for each segment in the scan line time, for a single thermal element and storing the information in a look-up table. However, the methods of Tolle, Tainer, and Wiklof, command a large processor memory and consume a vast amount of processor time, and as such, these methodologies become less desirable, particularly as more thermal elements and/or adjacent thermal elements in dot history are taken into consideration. Moreover, the above methods tend to monopolize and over-tax the processor in a printing system. Thus, a more efficient method of printing employing look-up tables is needed. Further, a more desirable location for storing the look-up tables would be preferred.

SUMMARY OF INVENTION

In one aspect, the invention provides a method of processing thermal elements in a thermal element group. In doing so, the method permits the reduction of processor time such that it is practical to consider dot history of the thermal elements when creating a printed image.

The method comprises accessing, from a specific supply, printing parameters. The printing parameters typically include a microstrobe number and microstrobe energy values and are stored in a printer memory. Thereafter, a dot history pattern and a number of thermal elements for the thermal element group are determined.

Next, thermal elements are assigned to the thermal element group based on the number of thermal elements in the thermal element group. In one embodiment, the thermal elements assigned to the group of thermal elements comprise consecutive thermal elements. The thermal element group is packed into the dot history pattern to generate a packed dot history pattern. From the packed dot history pattern, a packed thermal element number is determined. A packed index, with a packed index length based on the packed thermal element number, is created. Packed index values are determined to occupy the packed index length. The packed index values are based on the packed dot history pattern.

Thereafter, microstrobes are divided based on the microstrobe number stored in the printer memory. This produces divided microstrobes. Packed binary pulse numbers are assigned to the divided microstrobes based on a strobe pattern. The packed binary pulse numbers typically correspond to each of the packed index values occupying the packed index length. Packed strobe numbers based on the packed binary pulse numbers are determined. The packed strobe numbers generally correspond to each of the packed index values occupying the packed index length.

The printed image is then created using a bit map pattern, the packed dot history pattern, the packed index values, the packed strobe numbers, and the microstrobe energy values. In one embodiment, the bit map pattern, the packed dot history pattern, the packed index values, and/or the packed strobe numbers are stored in printer memory.

Further, printing parameters can be accessed by loading a cartridge containing a supply of ribbon into a printer when the cartridge includes a memory cell having the printing parameters stored therein. The memory cell is generally secured to the cartridge and can be erased after the supply of ribbon stored within the cartridge is exhausted. Also, the memory cell can contain an electronic lock capable of being unlocked by an electronic key associated with the printer. The electronic key can be accessed by the printer and used to unlock the supply specific printing parameters stored in the memory cell.

In one embodiment, entire raster lines of the packed strobe numbers are determined and two or more of the entire raster lines are used to created the printed image.

BRIEF DESCRIPTION OF DRAWINGS

Embodiments of the invention with reference to the accompanying drawings are for illustrative purposes only. The invention is not limited in its application to the details of construction or the arrangement of the components illustrated in the drawings. The invention is capable of other embodiments or of being practiced or carried out in other various ways. Like reference numerals are used to indicate like components.

FIG. 8 illustrates, in one embodiment, microstrobe energy values assigned to each of the microstrobes in the partially completed organizational table of FIG. 6.

FIG. 9 illustrates, in one embodiment of the invention, the partially completed organizational table of FIG. 6 after strobe numbers have been calculated and inserted, thus completing the organizational table for the single thermal element.

FIG. 13 illustrates, in one embodiment of the invention, the partially completed multiple thermal element organizational table of FIG. 12 further comprising packed binary pulse numbers assigned to divided microstrobes.

FIG. 14 illustrates, in one embodiment of the invention, the partially completed multiple thermal element organizational table of FIG. 13 after packed strobe numbers have been calculated and inserted, thus completing the multiple thermal element organizational table for the group of thermal elements.

DETAILED DESCRIPTION OF THE PREFERRED EMBODIMENT

Figure 1:
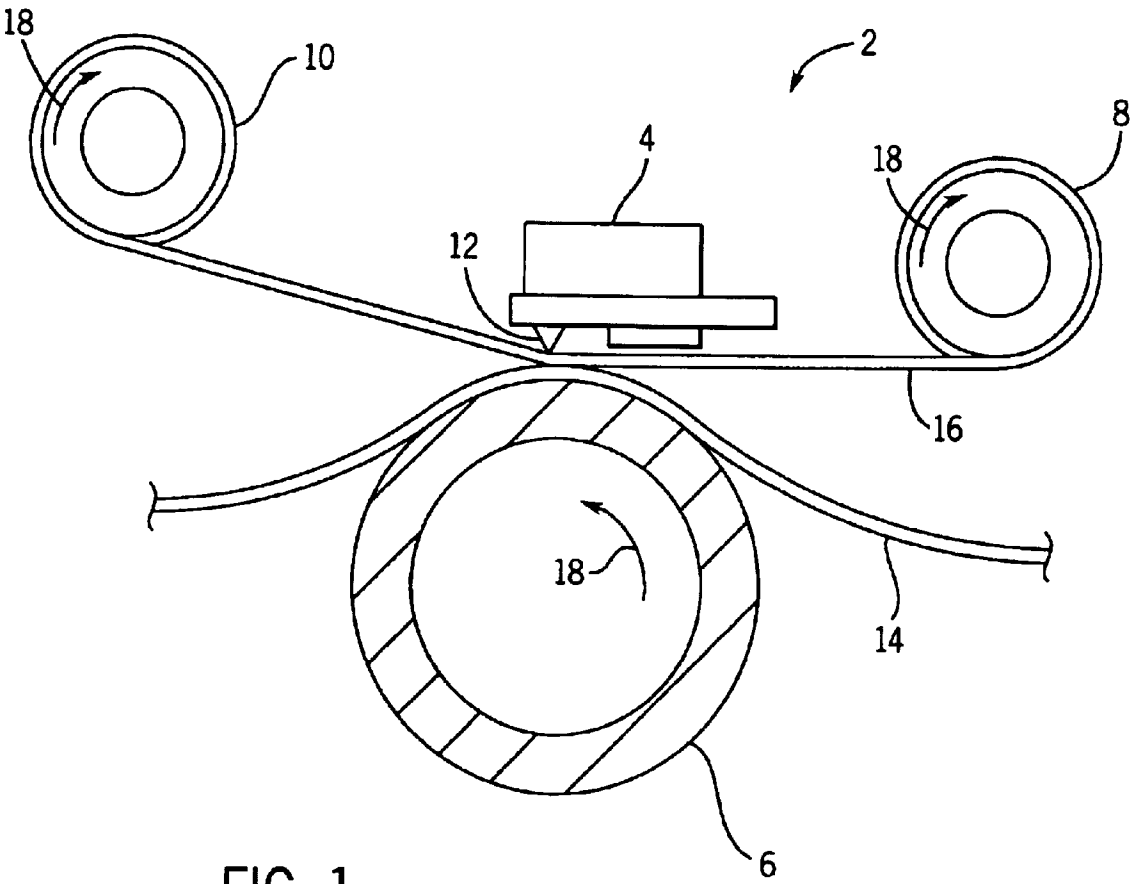
FIG. 1 illustrates an embodiment of a printing process for use with the invention.

Embodiments of the invention are described below with reference to the accompanying drawings and are for illustrative purposes only. The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for the purpose of description and illustration and should not be regarded as limiting.

Referring to FIG. 1, a typical thermal printing arrangement 2 is illustrated. The printing arrangement 2 comprises a printhead 4, a platen roller 6, a supply delivery roller 8, and a supply take-up roller 10.

Figure 3:
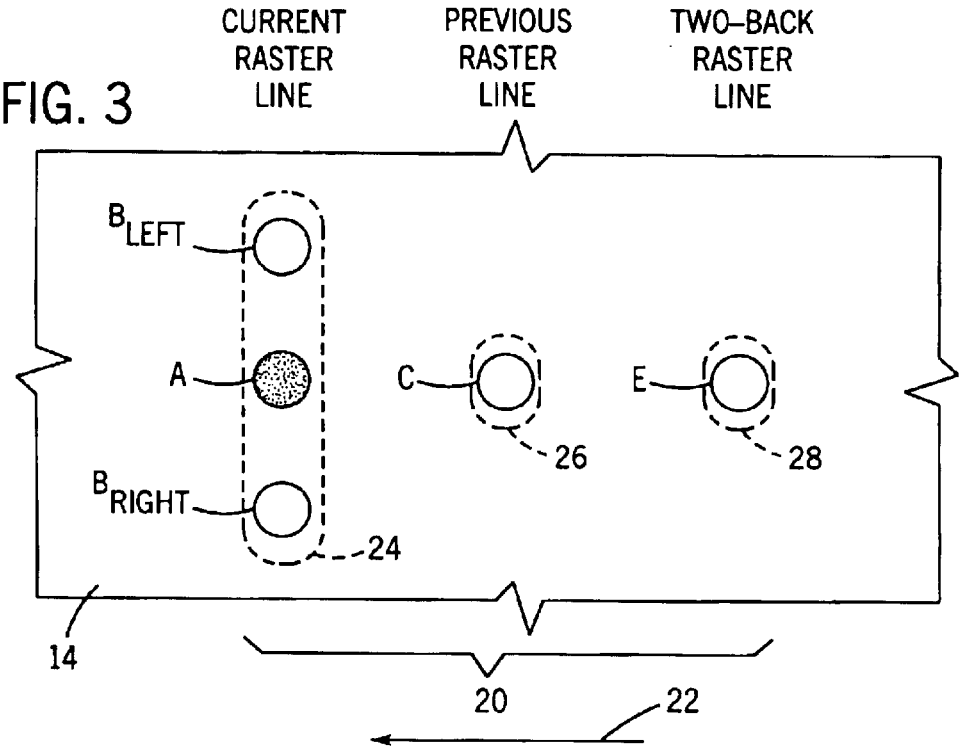
FIG. 3 illustrates an example of a dot history pattern, generated on a media, which can be used in one embodiment of the invention using the printing process of FIG. 1.

A printhead 4 is typically equipped with a linear array of thermal elements 12. The number of thermal elements in the linear array can vary, with a characteristic printhead 4 employing one thousand two hundred forty-eight (1,248) thermal elements 12. Each thermal element 12 produces heat in response to energy supplied by a microcontroller (not shown) associated with printhead 4. The microcontroller applies a voltage or current to each thermal element 12 to heat the thermal elements to a level sufficient to transfer dots. The dots form at sites (e.g., A, $B_{left}$, $B_{right}$, C, E, as illustrated in FIG. 3) on a media 14. This is accomplished when a thermally-sensitive supply 16 comes into thermal contact with the thermal elements 12 while proximate media 14 as illustrated in FIG. 1. Directional arrows 18 in FIG. 1 indicate direction of travel of the various components in printing arrangement 2.

Figure 2:
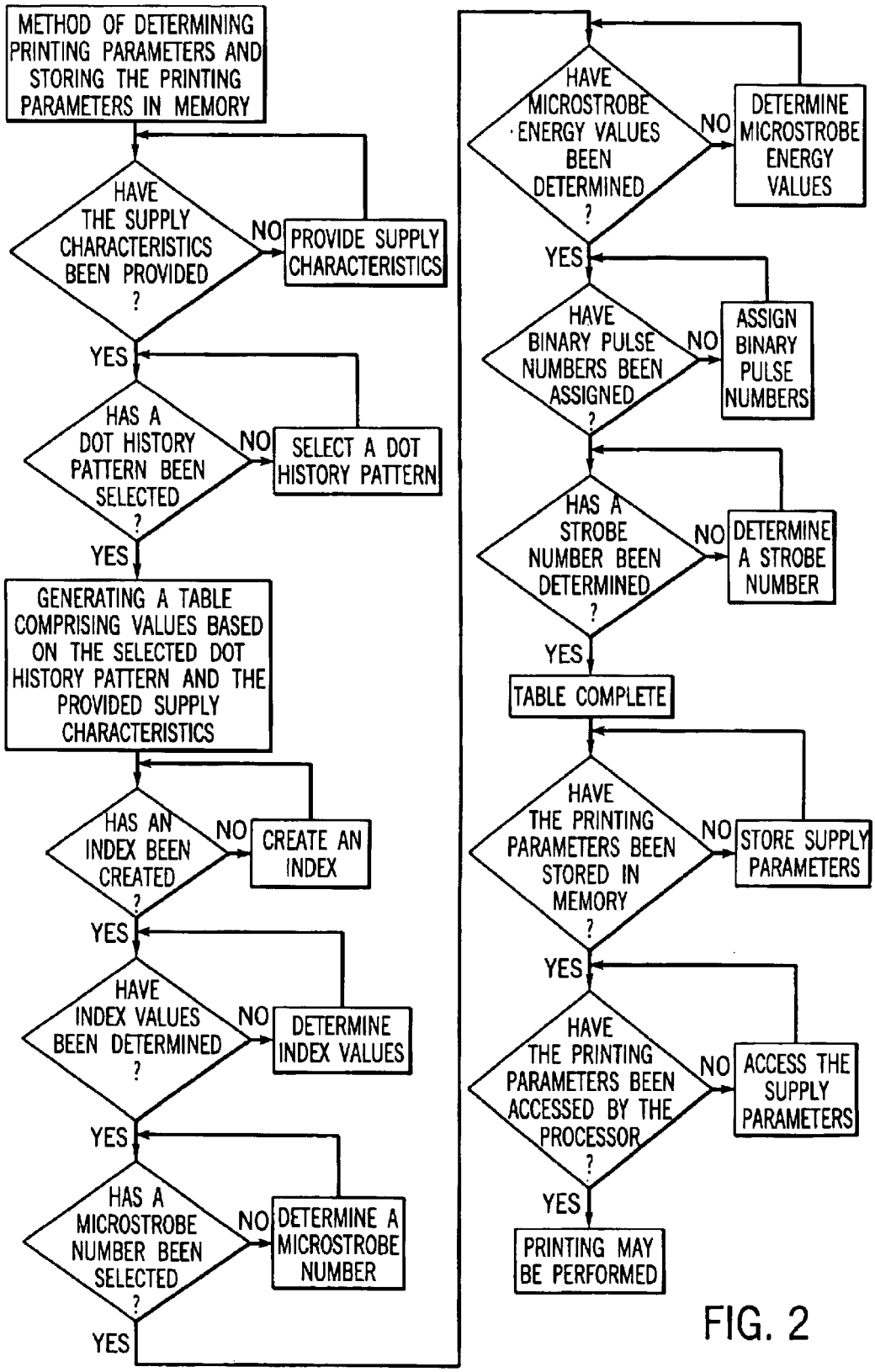
FIG. 2 illustrates a flow chart of the steps employed in processing a single thermal element, considering the dot history of that single thermal element, using the printing process of FIG. 1.

As illustrated in FIG. 2, a method of determining the amount of energy to be delivered to thermal element 12 for specific supply 16 employing dot history, and storing that amount in memory, is depicted. Thermal elements 12 require energy to produce a dot and, therefore, the method of FIG. 2 can be used with those thermal elements that are fired, wherein firing is defined as generating a dot, producing a burn, making a printed dot, etc., during printing, for example, using printing arrangement 2 of FIG. 1.

As shown in FIG. 2, the first step in one embodiment of a single thermal element being processed involves providing supply characteristics. Supply 16 is defined as that material that holds the ink, pigment, or other color-providing substance or material transferred to a media 14. As such, examples of supply characteristics can include supply width, supply length, supply thickness, ink color, and other like characteristics. Supply 16 can comprise donor ribbon or other thermally-sensitive materials for use in printing. Media 14 can comprise any substrate that accepts ink or pigment transferred from supply 16. As one example, media 14 can comprise an adhesive-backed roll of material with an opposing dye-accepting surface. For each specific supply 16 available to a printer, supply characteristics can be ascertained and provided.

Referring to FIG. 3, after the specific supply characteristics have been provided, a dot history pattern 20 is selected. A dot history pattern 20 is that pattern of printed dots and/or unprinted dot sites (e.g., A, $B_{left}$, $B_{right}$, C, and E) that result when thermal elements 12 (FIG. 1) fire or do not fire. A dot can be generated (FIG. 1) on the media 14 when a thermal element 12 proximate that site is fired. For example, in FIG. 3, a dot is generated at site A on the media 14 when a thermal element 12 (FIG. 1) proximate site A is heated to a level sufficient to transfer ink from the supply 16 to the media 14. If the thermal element is not sufficiently heated, no dot will be generated and the site will remain blank or unprinted.

Figure 4:
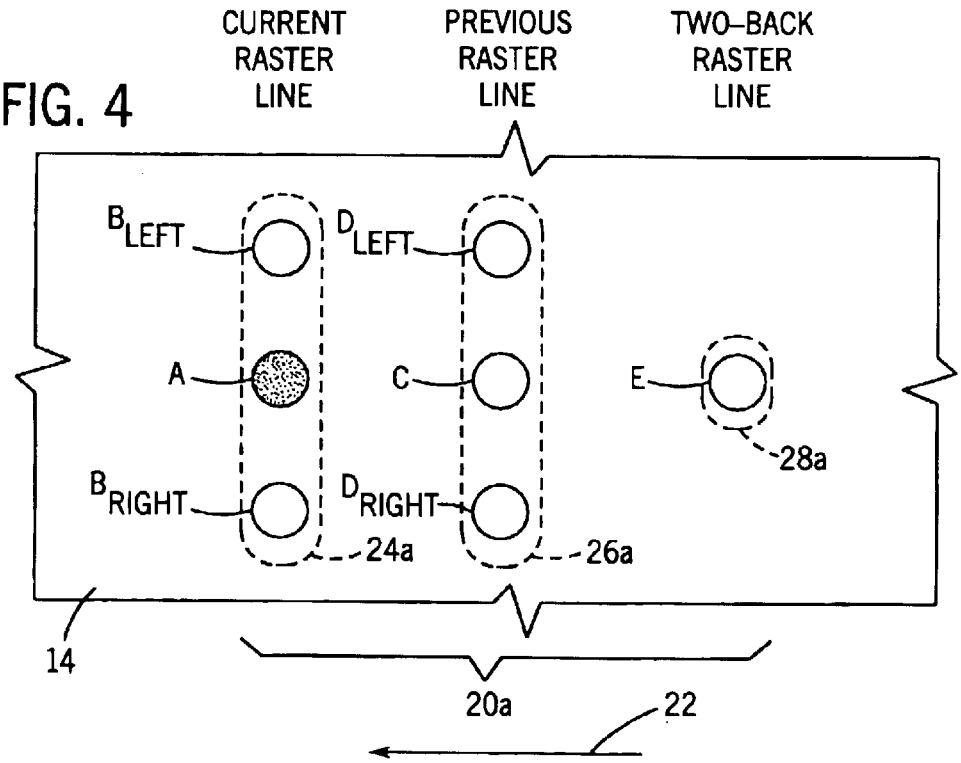
FIG. 4 illustrates a further example of a dot history pattern, generated on a media, which can be used in one embodiment of the invention using the printing process of FIG. 1.

Throughout the description, examples such as FIGS. 3 and 4 are utilized to assist in the explanation of the invention. In each example and elsewhere, the thermal element proximate site A, which is capable of producing a dot at site A, will be referred to as the selected thermal element. Such a selected thermal element will as a reference point in the examples.

Dots at sites $B_{left}$ and $B_{right}$ are also generated on a media 14 when thermal elements 12 proximate sites $B_{left}$ and $B_{right}$, respectively, are heated to a level sufficient to transfer pigment from supply 16 to media 14. Again, if sufficient heating fails to be accomplished, no dot will be generated. Sites $B_{left}$ and $B_{right}$ are those sites immediately adjacent the selected thermal element in the current raster line as illustrated in FIGS. 3 and 4.

Sites C and E are defined somewhat differently. In FIG. 3, for example, a dot at site C is a dot that has been produced by the selected thermal element proximate site A except that the dot has now been shifted one generation. In other words, site C, which is located in the previous raster line, is the old dot from site A. The shift of the dot (or lack of a dot) from site A to site C occurs as media 14 advances during printing relative to the direction of printing arrow 22. Likewise, a dot at site E is a dot that has been produced by the selected thermal element proximate site A except that the dot has now been shifted two generations. In other words, site E, which is located in the two-back raster line, is the old dot from site C and the even older dot from site A. Here again, the shift of the dot (or lack of a dot) from site A, to site C, to site E occurs as media 14 advances during printing relative to the direction of printing arrow 22.

Referring to FIGS. 3 and 4, two examples of dot history patterns that can be used for the single thermal element being processed are illustrated. In addition to those dot history patterns illustrated, a variety of other patterns may be employed. For clarity, a general explanation of a dot history pattern using FIG. 3 as an example will be provided to assist the reader in understanding the invention. Referring to FIG. 3, dot history takes into account burn patterns 24, 26, 28, of thermal elements over several consecutively-fired raster lines. As one of the thermal elements is fired, it produces a dot on media 14. If thermal element 12 remains idle, no dot is formed. Thus, a dot or a blank area will result at site A depending on whether the selected thermal element is fired or not fired. Likewise, thermal elements adjacent to the selected thermal element can create adjacent dots, or leave adjacent blank areas, at sites such as $B_{left}$ and $B_{right}$. As media 14 advances, dots and blank areas that have been created in past generations (e.g., C, $D_{left}$, $D_{right}$, E in FIGS. 3 and 4) can be considered as part of a dot history pattern. Thus, in the simplest terms, as noted earlier, dot history takes into account the firing, over time, of a thermal element and/or an adjacent thermal element or elements.

Specifically with regard to FIG. 3, current burn pattern 24 is formed when the selected thermal element proximate site A and the adjacent thermal elements proximate sites $B_{left}$ and $B_{right}$ fired, or did not fire, during the current raster line. Previous burn pattern 26 is formed when the selected thermal element proximate site A fired, or did not fire, in the previous raster line, and the two-back burn pattern 28 is formed when the thermal element proximate site A fired, or did not fire, in the two-back raster line. As media 14 moves, thermal elements either fire, or do not fire, and burn patterns 24, 26, 28 are created in each raster line. Accounting for the various burn patterns 24, 26, 28 forms a dot history pattern 20.

FIG. 4 illustrates another example of a dot history pattern that can be used with the single thermal element being processed. Burn patterns, 24*a*, 26*a*, 28*a*, are shown for dot history pattern 20*a* of FIG. 4. Unlike dot history pattern 20 of FIG. 3, the dot history pattern 20*a* of FIG. 4 also incorporates thermal elements adjacent to the selected thermal element that fired, or did not fire, in the previous raster line, e.g. $D_{left}$, $D_{right}$.

A multitude of variations in the burn pattern configurations can be employed. Also, the number of raster lines that are labeled and monitored can be extended and/or augmented as convenient (e.g., current, previous, two-back, three-back, and so on). However, the more thermal elements and generations that are examined, the more complex dot history calculations become because more possible dot history pattern combinations exist.

During printing, new current, previous, and two-back raster lines are continually defined. For example, as a new raster line is printed, the current raster line assumes the position of the previous raster line, the previous raster line assumes the position of the two-back raster line, and the newly-printed raster line becomes the current raster line. As new raster lines are generated, the raster lines correspondingly define burn patterns, which continually change depending on the firing, or lack of firing, of thermal elements.

To better appreciate the benefits of utilizing dot history, an example using the dot history pattern 20 of FIG. 3 is provided. If the selected thermal element associated with site A has been energized twice consecutively, it generates two dots. Since the dots are printed consecutively, a dot will appear in the current burn pattern at site A and in the previous burn pattern at site C. As media 14 proceeds relative to the direction of printing arrow 22, the dot at site C will shift to site E, the dot at site A will shift to site C, and a new dot can be produced at site A. However, because the time period between the generation of dots is relatively short (e.g., about 6.67 milliseconds), the selected thermal element will retain heat and be hot after having produced the two consecutive dots. Thus, the amount of energy required to raise the temperature of the selected thermal element to a level sufficient to produce a new dot at site A in the current burn pattern is reduced because of the retained heat. The selected thermal element will require less energy to generate a dot, and therefore, less energy can be sent to the thermal element.

On the other end of the spectrum, a thermal element that has remained idle can also be considered. If the selected thermal element is scheduled to generate a printed dot at site A, and the selected thermal element has been idle such that no dot is found at sites C and/or E, the selected thermal element will have retained little or no heat. As a result, a greater amount of energy will be required for the selected thermal element to reach a temperature sufficient to produce a dot when compared to the instance when a selected thermal element was previously fired. In other words, the selected thermal element is cold and requires more energy to heat up to generate a dot on media 14.

Using dot history to accommodate heat, if any, retained by thermal elements (or heat radiated by adjacent thermal element neighbors, if any) permits the printing system to account for and adjust the amount of energy delivered to each thermal element. This helps prevent malformed or unaesthetic images. Also, dot history allows for the regulation of energy by accounting for many different energy levels.

Performing the dot history calculations to determine the various energy levels is a task that is typically accomplished by the processor in the printing system. If the dot history calculations, which includes performing numerous calculations regarding the specific supply characteristics, are undertaken during printing, the printing process can be slowed.

The decision to use one dot history pattern over another can be made based on numerous factors. Such factors include, but are not limited to, the supply characteristics, the processor size, the processor speed, the amount of heat being retained by a thermal element, the amount of heat radiated by adjacent neighbors, the printer speed, etc.

Referring again to the method illustrated in FIG. 2, after a desired dot history pattern 20 is selected, a thermal element number is determined. The thermal element number is defined as the sum of the number of sites where thermal elements can create, or have created, dots in the burn patterns for the dot history pattern selected, excluding site A associated with the selected thermal element in the current burn pattern. Therefore, the thermal element number for FIG. 3 is four. Four sites, namely $B_{left}$, $B_{right}$, C, and E, are included in the result to achieve the thermal element number for FIG. 3. FIG. 4 uses a different dot history pattern. The thermal element number for FIG. 4 is six because there are six sites, namely $B_{left}$, $B_{right}$, C, $D_{left}$, $D_{right}$, and E.

Figure 5:
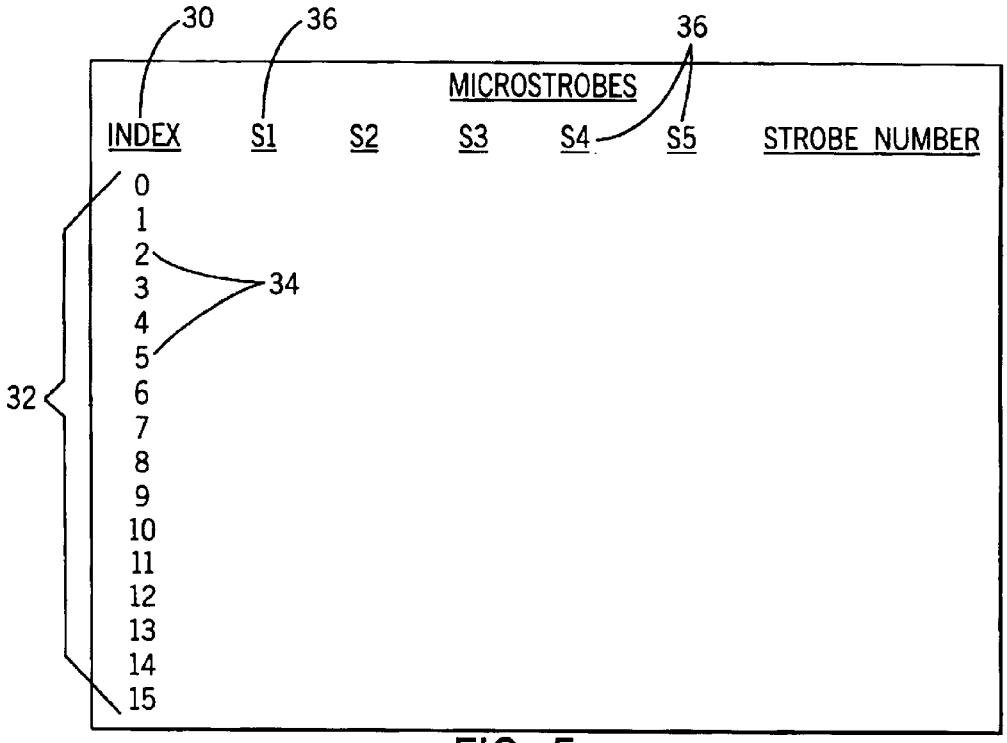
FIG. 5 illustrates a partially completed organizational table for processing the single thermal element, as detailed in FIG. 2, comprising index values, based on the dot history pattern of FIG. 3, occupying an index length.

After determining the thermal element number, an index 30 having an index length 32, as illustrated in FIG. 5, can be generated. In preferred embodiments, index length 32 corresponds to the number of rows used in the table of FIG. 5. Index length 32 is based, at least in part, on the thermal element number. In preferred embodiments, index length 32 is also based on whether energy is delivered to each thermal element 12 by the microcontroller. For thermal element 12 to fire and produce a dot, a sufficient amount of energy is delivered. For thermal element 12 to remain idle, and thus not produce a dot, no energy or an insufficient level of energy is delivered. As such, there are two possible energy value combinations for each thermal element 12 (i.e., either the thermal element receives energy or it does not). Having determined the thermal element number, index length 32 can be calculated based on the thermal element number and the number of possible energy value combinations (e.g., two (2) for a thermal element). In a preferred embodiment, index length 32 is calculated using the formula:

$$\text{Index length} = (\text{number of possible energy value combinations})^{\textit{thermal element number}}$$

In this preferred embodiment, index length 32 is the number of possible energy value combinations raised to the thermal element number power.

Using the dot history pattern of FIG. 3 as an example, there are again two possible energy value combinations. Also, the thermal element number is four. Inserting those values into the formula of the preferred embodiment (see above) yields an index length of $2^4$, or sixteen. As illustrated in FIG. 5, index length 32 correspondingly has sixteen values (represented by the numbers 0 to 15 in index 30).

As a further example, if the same index length formula is applied to the dot history pattern of FIG. 4, the formula yields an index length of $2^6$, or sixty-four. Thus, it is worthwhile to note that the more thermal elements accounted for using dot history, the larger the index will be.

After index length 32 is established, index values 34 can be generated to occupy the index 30 over the entire index length 32. Index values 34 are based on the selected dot history pattern 20. As the names suggest, index 30 and index values 34 can be used to arrange and assemble corresponding values of data in an organized manner. In preferred embodiments, index values 34 can represent one or more of the possible combinations of intermittently fired thermal elements 12.

Since an index length 32 of sixteen was produced using the dot history pattern 20 of FIG. 3, index values 34 can correspondingly be determined. While index values 34 can be generated in a variety of ways, in one preferred embodiment, the index values are calculated by assigning binary numbers (e.g., a 1 or a 0) to each site in the burn patterns 24, 26, 28. Thereafter, in preferred embodiments, the binary numbers for the sites proximate thermal elements are inserting into the following formula:

$$\text{Index value}=B_{left}+(2\times B_{right})+(4\times C)+(8\times E)$$

If a thermal element has been fired to generate a dot at one or more of sites $B_{left}$, $B_{right}$, C, and/or E, a 1 is inserted into the formula for those sites. In other words, a 1 represents that the thermal element is ON and the thermal element receives energy. If, however, a thermal element has not been fired and no dot is generated at one or more of the sites, a 0 is inserted into the formula for those sites. In other words, a 0 represents that the thermal element is OFF and the thermal element does not receive energy or received an insufficient level of energy. Using the index value formula above, and inserting the binary numbers based on the combinations of thermal element firing in the dot history pattern, a series of consecutive numbers from 0 to 15 can be generated for the dot history pattern 20 of FIG. 3. These index values 34 are arranged in sequential order, from smallest to largest, as illustrated in FIG. 5. Should a different dot history pattern be selected, the index value formula can be modified to account for other thermal elements (e.g., $D_{left}$ and $D_{right}$) as illustrated in FIG. 4.

Once the index values 34 have been determined as illustrated in FIG. 5, a microstrobe number representing microstrobes 36 can be selected. Microstrobes 36 comprise a pulse of energy delivered to a thermal element by a microcontroller during a print interval. A print interval is defined as the time spent printing one raster line. The microstrobe number comprises the number of microstrobes 36 that will be utilized (i.e., the number of pulses a thermal element shall be provided for preheating and/or dot-generating purposes). The microstrobe number can be selected as convenient while considering the specific supply characteristics such as ribbon thickness, ink melting point, and the like. Microstrobes 36 are typically separated by a short amount of time (e.g., about 200 hundred microseconds) while a print interval comprises a longer amount of time (e.g., about 6.67 milliseconds).

In preferred embodiments, the microstrobe number selected is between two and eight. In one preferred embodiment, as illustrated in FIG. 5, a microstrobe number of five is selected. As shown in FIG. 5, the microstrobes 36 are labeled S1, S2, S3, S4, and S5 and are arranged within the table.

Figure 6:
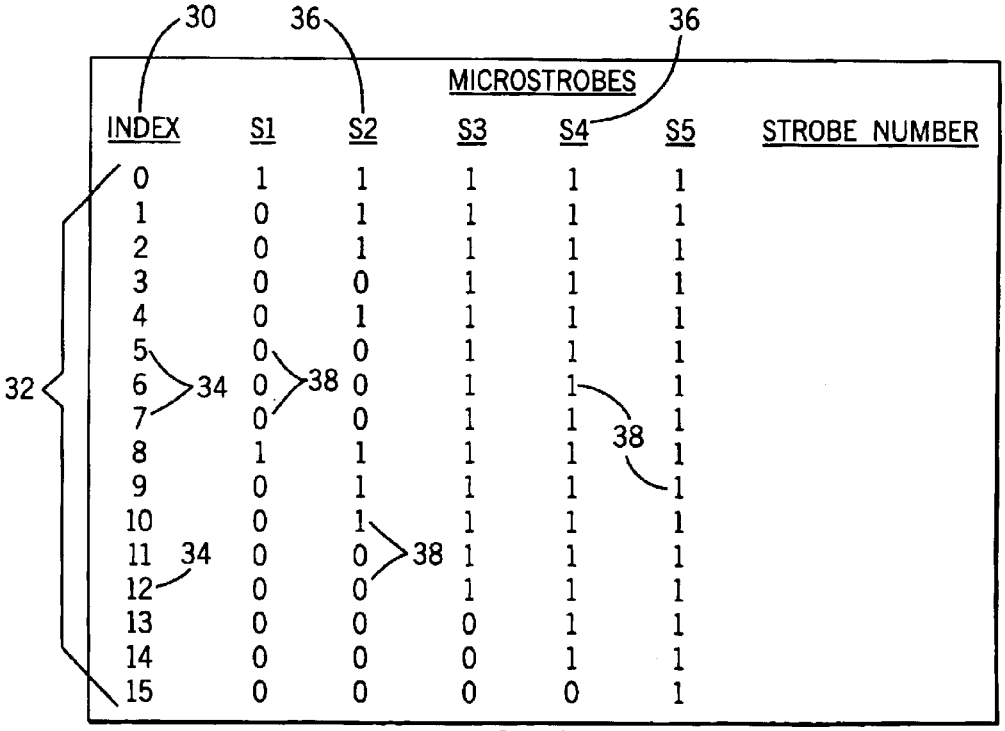
FIG. 6 illustrates, in one embodiment, the partially completed organizational table of FIG. 5 further comprising binary pulse numbers assigned to microstrobes.

Once the microstrobe number is determined, binary pulse numbers 38, as illustrated in FIG. 6, are assigned to the various microstrobes 36. If a 1 is assigned to a microstrobe, then a pulse of energy is delivered to a thermal element at that time. In other words, a 1 represents that the microstrobe is ON and the microstrobe receives energy. If a 0 is assigned to a microstrobe, then no pulse of energy is delivered to the thermal element at that time. In other words, a 0 represents that the thermal element is OFF and the microstrobe does not receive energy. Even though a microstrobe may be assigned a 1, and a pulse of energy delivered, a dot is not necessarily generated. Unlike the binary numbers earlier assigned to the thermal elements, the binary pulse numbers 38 assigned to the microstrobes 36 only indicate delivery of energy, and not a printed dot. Despite energy being delivered during a microstrobe 36, the energy can be sufficient for preheating while remaining insufficient to generate a dot. Whether a thermal element is preheated, or generates a dot, depends upon the temperature that the thermal element reaches upon receipt of the energy.

To make the determination of whether to assign a 1 or a 0 to a particular microstrobe 36, a suitable microstrobe pattern is selected. The microstrobe pattern is defined as the order in which microstrobes 36 are fired. To determine the microstrobe pattern, the microstrobe 36 that actually causes thermal elements 12 to produce dots, as well as which of the microstrobes are used for preheating thermal elements, is taken into account.

Figure 7:
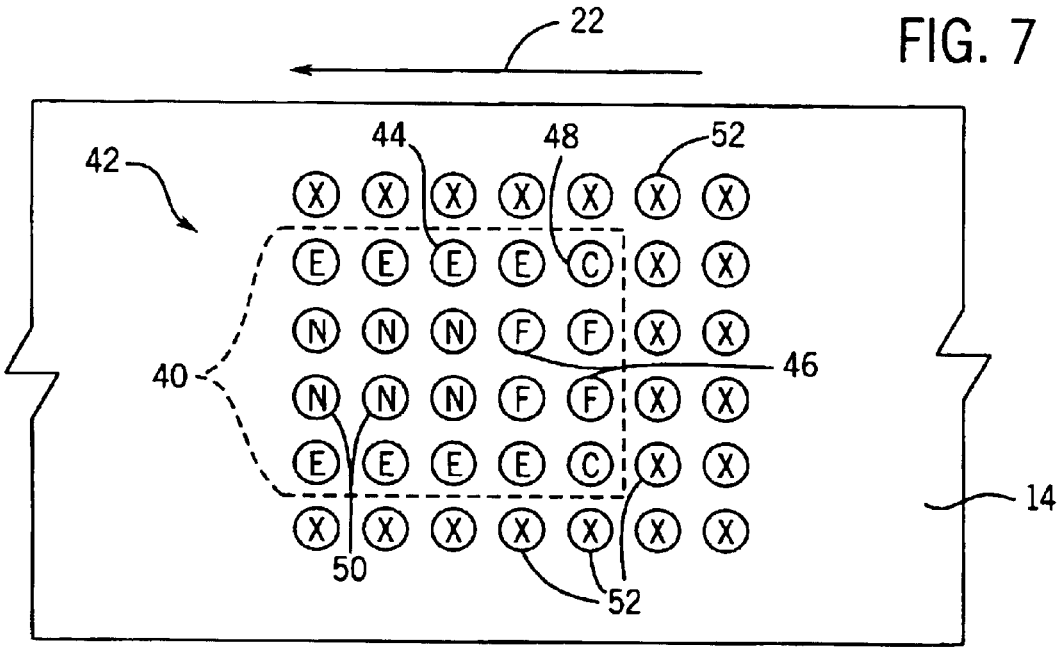
FIG. 7 illustrates an example of an image to be printed on the media using the printing process of FIG. 1.

The microstrobe pattern can be determined, at least in part, by considering how an image to be printed 40, an example of which is illustrated in FIG. 7, at a particular location on the media 14 will be formed. In FIG. 7, an example of an image to be printed 40 (e.g., a rectangular object) is represented within a group of dots 42. As shown, the image to be printed 40 comprises an edge dot 44, a leading edge dot 46, a leading corner dot 48, and an interior dot 50. Also depicted in FIG. 7 are several unprinted sites 52, where no dot is produced around image to be printed 40. Based on the selected microstrobe pattern and the image to be printed 40, binary pulse numbers 38 are assigned to each of the microstrobes 36 for each index value 34, until the index length 32 in FIG. 6 is fully occupied.

In one preferred embodiment, the strobe pattern comprises the situation where the S5 microstrobe 36 is the microstrobe that generates dots. Therefore, the S5 microstrobe 36 is always assigned a 1, regardless of the corresponding index value 34. Thereafter, each of the microstrobes 36, namely S1–S4, is used for the purpose of preheating a thermal element 12. In this embodiment, the S4 microstrobe 36 is assigned a 1 if there are any adjacent pins that did not generate a burn. As such, the S4 microstrobe 36 is generally the microstrobe associated with edge dots 44 and not used inside an object to be printed 40 which comprises solid dots. The S3 microstrobe 36 is the microstrobe that is associated with leading edges 46 of an object to be printed 40. Continuing, the S2 microstrobe 36 is the microstrobe that is associated with leading corners. As such, the S2 microstrobe 36 generally receives energy if less than two adjacent thermal elements received energy, but with some exceptions. For example, referring to FIG. 3, an exception is made when the two adjacent thermal elements comprise the thermal element associated with site E and the thermal element associated with either $B_{left}$ or $B_{right}$. The exception is employed because the thermal element associated with site E, in the two-back raster line, contributes only a small amount of heat to the selected thermal element associated with site A. And finally, the S1 microstrobe 36 is the microstrobe that is associated with a selected thermal element when neither of the thermal elements associated with sites $B_{left}$, $B_{right}$, or C receives energy. With the S1 microstrobe 36, the thermal element associated with E is usually disregarded and, therefore, the index values 34 associated with 0 and 8 will permit the S1 microstrobe to receive energy. In many embodiments, a suitable strobe pattern, as determined above, can be used with a wide variety of supplies.

In another preferred embodiment, the microstrobe labeled S1 is chronologically the first microstrobe that is provided a pulse of energy by the microcontroller. Thereafter, microstrobes S2, S3, and S4 sequentially receive pulses of energy to keep a thermal element preheated and/or generate a dot. Again, the microstrobe labeled S5 is the microstrobe that causes a thermal element to become sufficiently heated to generate a dot at a site.

In preferred embodiments, where microstrobe S5 is the microstrobe that generates the dots, microstrobe S5 delivers the largest pulse of energy when compared to the other microstrobes. It is not required that the last microstrobe in the series of microstrobes be the one that generates the dots, nor is it required that five microstrobes be selected.

Using the binary pulse numbers 38 (i.e., the ones and zeros assigned to the microstrobes 36), and knowing the microstrobe number, microstrobe energy values 54 are determined for each microstrobe 36 as illustrated in FIG. 8. Microstrobe energy values 54 represent the amount of energy (in watts) in each microstrobe pulse supplied to a thermal element at a given time to assist in keeping that thermal element preheated and/or generate a dot. The microstrobe energy routed to each thermal element during printing is determined based on the specific supply being used for printing. For example, if a chosen supply requires thermal elements to be exceptionally hot to generate a dot, the microstrobe energies might be accordingly set exceptionally high to keep the temperature of the thermal element high.

To determine appropriate microstrobe energy values 54, testing is often conducted for each specific supply. Typically, testing involves a trial and error method of assigning microstrobe energy values 54. For example, initial microstrobe energy values 54 are assigned to microstrobes 36, and the microstrobes are fired to produce one or more raster lines. If, during the test firing, too much ink is transferred from the ribbon to the media, one or more of the initial microstrobe energy values 54 for one or more of the microstrobes 36 can be reduced. Conversely, if during the test firing too little ink is transferred from the ribbon to the media, one or more of the initial microstrobe energy values 54 for one or more of the microstrobes 36 can be increased. Whether too much or too little ink is transferred to the media during firing can be a subjective, aesthetically-motivated determination based on whether a dot provides sufficient coverage of ink on the site where the dot was produced. By completing one, and often several, iterations of the trial and error method for a specific supply, microstrobe energy values 54 can be ascertained.

After binary pulse numbers 38 and microstrobe energy values 54 have been determined, a strobe number 56 can be calculated. Strobe number 56 represents a combination of microstrobes 36 (each of which corresponds to a microstrobe energy value 54 from FIG. 8) used to keep a thermal element preheated and/or generate printed dots. Each strobe number 56 generally corresponds to an index value 34 in the index 30 as illustrated in FIG. 9. In a preferred embodiment, a strobe number 56 corresponding to each index value 34 is calculated by inserting the assigned binary pulse numbers 38 for each of the microstrobes 36 into the following formula:

$$\text{Strobe number}=S1+(2\times S2)+(4\times S3)+(8\times S4)+(16\times S5)$$

For example, the strobe number 56 for the index value of 3 in FIG. 9 is calculated by inserting binary pulse numbers 38 into the above formula. Since S1 and S2 are zeros and S3, S4, and S5 are ones in FIG. 9, strobe number 56 for the index value of 3 is 28(0+(2×0)+(4×1)+(8×1)+(16×1)). For each index value in FIG. 9, a strobe number 56 is calculated and arranged using the binary pulse numbers 38 assigned to microstrobes 36.

At the point where the table in FIG. 9 has been assembled, a microstrobe number has been selected as illustrated in FIG. 5, microstrobe energy values 54 have been determined as illustrated in FIG. 8, and a strobe number has been determined as illustrated in FIG. 9. Therefore, the next step in the method comprises storing the microstrobe number, the microstrobe energy values 54, and the strobe numbers 56 in a memory associated with the specific supply for which these printing parameters were calculated. By storing these supply specific printing parameters in the memory, they can quickly, easily, and efficiently be accessed by a processor in a thermal printing system when, for example, a supply container (e.g., a cartridge), bearing the supply is loaded into the printing system.

Typically, a processor can make all, or almost all, of the energy value calculations for thermal elements while the printer is printing. In contrast, a look-up table of supply specific printing parameters comprising a microstrobe number, microstrobe energy values, and strobe numbers can be generated and provide partial, pre-calculated printing instructions for each specific supply. Thus, when printing is to be performed, the processor in the printing system need not perform many of the printing instruction calculations during printing. The calculations, corresponding to each new supply, have already been determined and stored in the memory associated with the supply. A printer can access the supply specific printing parameters, store that information in a random access memory within the printer, and permit the processor within the printer to use that stored information for printing. As such, the workload of the processor, during printing, is reduced.

In one embodiment, the memory comprises a solid-state memory device, a RAM (random-access memory), a non-volatile RAM, an EEPROM (electrically erasable programmable read-only memory), or a flash memory. Also, in another embodiment, the memory can comprise a memory cell located proximate the supply by being secured to the outside of a supply container, to the inside of the supply container, or otherwise.

In one embodiment, the memory cell can be erased after the supply stored within the supply container is exhausted. In another embodiment, the memory cell can contain an electronic lock capable of being unlocked by an electronic key associated with the printer. The electronic key can be accessed by the printer and permit the printer to unlock the supply specific printing parameters stored in the memory cell.

In one embodiment of a printing system, a cartridge with a specific supply is loaded into the printer. The processor in the printing system accesses the supply parameters on the memory cell and printing instructions are generated. The processor then sends the printing instructions, or portions thereof, to the microcontroller. The microcontroller is a device that provides the thermal elements with the energy pulses known as microstrobes. The microcontroller receives the printing instructions from the processor and orchestrates delivery of energy during microstrobes resulting in the subsequent firing of the thermal elements disposed on the printhead to create a printed image.

Figure 10:
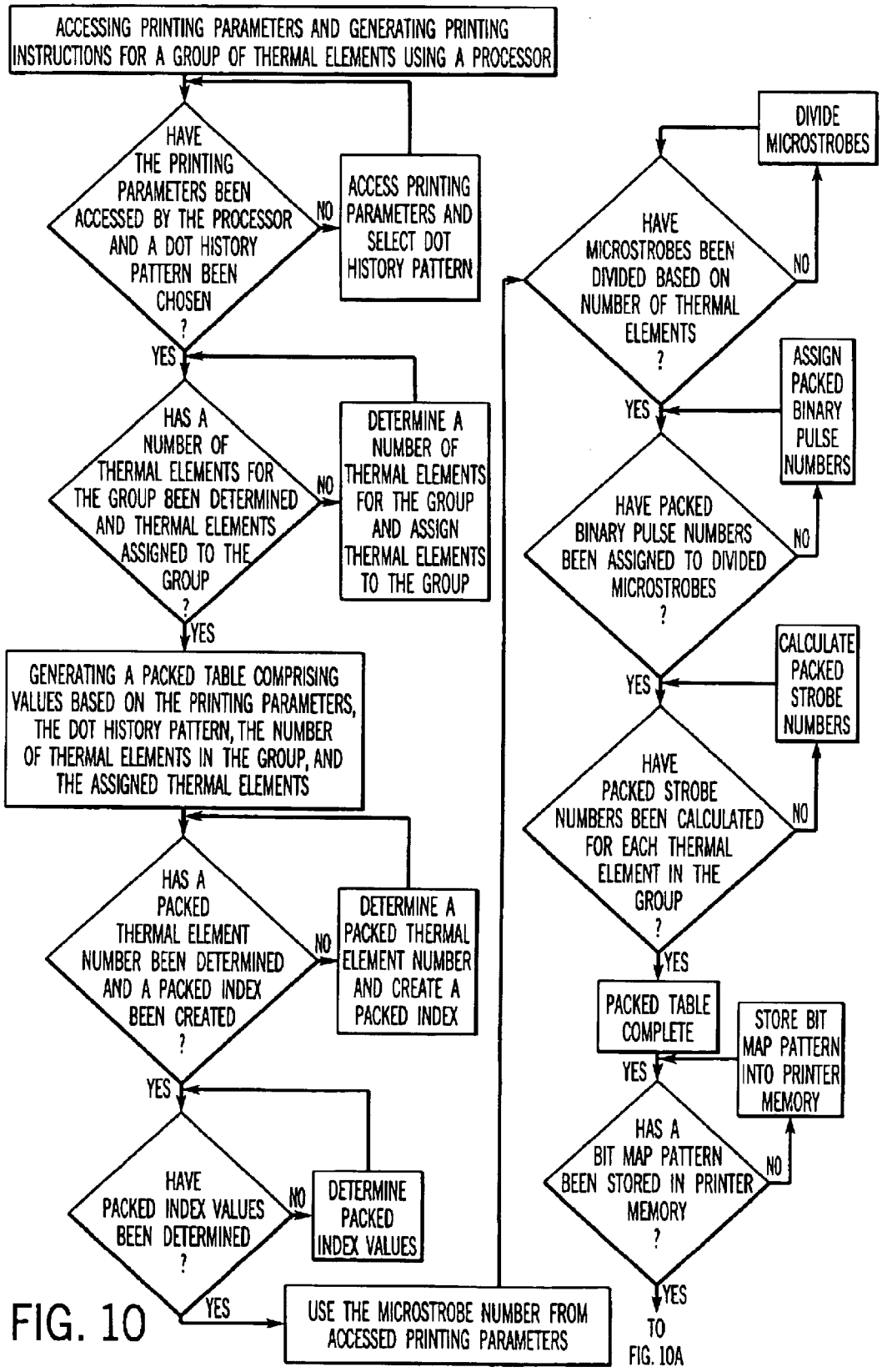
FIG. 10 illustrates a first portion of a flow chart comprising the steps employed, in one embodiment of the invention, to simultaneously process a group of thermal elements using the printing process of FIG. 1.
Figure 10A:
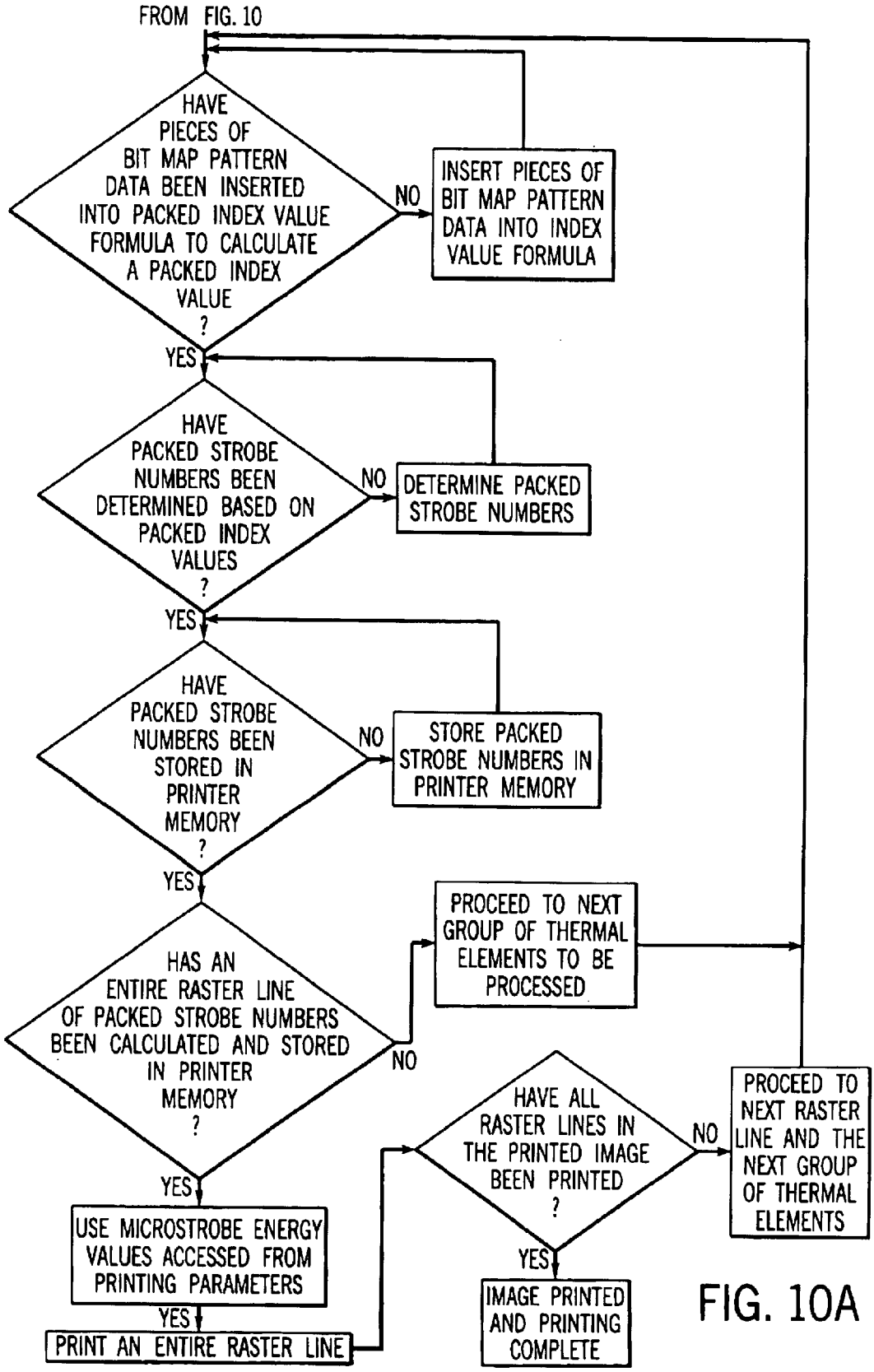
FIG. 10A illustrates a second portion of the flow chart of FIG. 10 further comprising the steps employed to simultaneously process the group of thermal elements.

In a preferred embodiment as illustrated in FIGS. 10 and 10A, the processor in printer 2 accesses one or more supply specific printing parameters (e.g. the microstrobe number, the microstrobe energy values 54, and the strobe numbers 42) from the memory cell and, instead of generating printing instructions for a single thermal element based on dot history, stores the supply specific printing parameters in a printer memory and generates printing instructions for a group of thermal elements (also known as multiple thermal elements) based on dot history. Such a method is illustrated in the flow chart of FIGS. 10 and 10A.

To begin, the processor accesses the one or more supply specific printing parameters from the memory associated with the supply and stores these parameters in printer memory for subsequent use. The printer memory can comprise a random access memory (RAM), or other types of memory. Thereafter, a number of thermal elements being simultaneously processed in the group is determined. Once the number of thermal elements in the group is decided, thermal elements are assigned to the group. While the invention can utilize any number of thermal elements to form the group, for purposes of illustration, four consecutive thermal elements are selected and assigned to occupy and/or fill the group. The selected and assigned group of thermal elements will be referred to as W, X, Y, and Z. It is not required that the thermal elements be consecutive for simultaneous processing, although it is preferred.

The next step in simultaneously processing the group of thermal elements is determining a dot history pattern. Referring back to FIG. 3, dot history pattern 20 which was used with the single, selected thermal element proximate site A is shown. Whether processing the group of thermal elements, or a single thermal element, similar dot history patterns can be used. Dot history pattern 20 of FIG. 3 was previously used to illustrate an example and/or embodiment for a single thermal element. Therefore, this dot history pattern will also be used to illustrate how the group of thermal elements can be processed. The invention can employ a multitude of dot history patterns, including the dot history pattern of FIG. 4.

Figure 11:
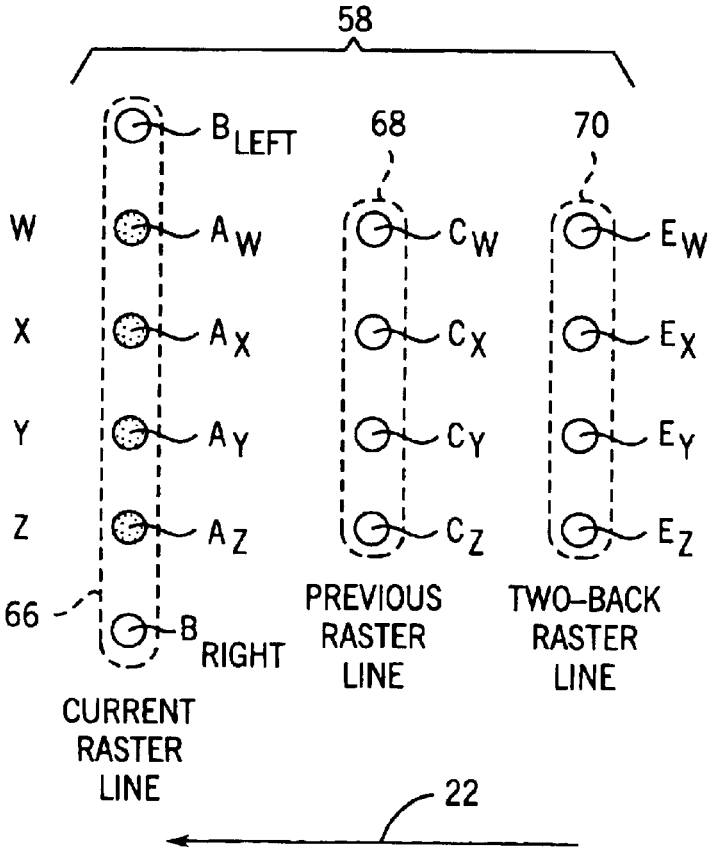
FIG. 11 illustrates, in the embodiment of the invention outlined in FIGS. 10 and 10A, the dot history pattern of FIG. 3 packed with the group of thermal elements.

For simultaneous processing to occur, the invention modifies the determined dot history pattern 20 of FIG. 3 by packing the group of thermal elements into the dot history pattern as illustrated in FIG. 11. Thus, the group of thermal elements, as opposed to a single thermal element, is established as the selected thermal element (i.e., the thermal element associated with site A in FIG. 3) as previously discussed.

As shown in FIG. 11, the four consecutive thermal elements assigned to the group (W, X, Y, and Z) are packed into the dot history pattern of FIG. 3. Therefore, instead of site A in FIG. 3 representing a single thermal element, site A is packed with the four consecutive thermal elements. As such, FIG. 11 depicts a packed dot history pattern 58. In packed dot history pattern 58, the group of thermal elements, namely W, X, Y, and Z, become the selected thermal element. Each of the four consecutive thermal elements (W, X, Y, and Z) is represented within site A. Thus, each of the four consecutive thermal elements in the group is considered to be a selected thermal element and is capable of producing dots at sites $A_w$, $A_x$, $A_y$, and $A_z$.

Packed dot history pattern 58 of FIG. 11 permits consideration of thermal elements that are adjacent to the selected thermal element. For example, FIG. 11 illustrates two adjacent thermal elements (e.g., $B_{right}$ and $B_{left}$) since the selected thermal element now comprises the group of thermal elements. Consideration of thermal elements in the previous raster line (e.g., $C_w$, $C_x$, $C_y$, $C_z$) and the two-back raster line (e.g., $E_w$, $E_x$, $E_y$, $E_z$) can also be undertaken when packed dot history pattern 58 is employed. The packed dot history pattern 58 of FIG. 11 exists in the printer memory, and not on any media. As the process of printing continues, several packed dot history patterns can be generated and then stored within printer memory.

Next, a packed thermal element number is determined. The packed thermal element number is generally calculated like the thermal element number for the single thermal element, but with one modification. For the single thermal element, the thermal element number comprised the sum of the number of sites where thermal elements can create, or have created, dots in the burn patterns for the dot history pattern selected, excluding site A associated with the selected thermal element in the current burn pattern. Notably, in calculating the thermal element number for the single thermal element, the site associated with the selected thermal element (i.e., A in FIG. 3) was excluded from the calculation. However, the exclusion of site A does not apply when the group of thermal elements is processed. The difference between the calculation of the thermal element number for the single thermal element and the group of thermal elements is the result of each thermal element in the group, namely W, X, Y, and Z, being both a selected thermal element and an adjacent thermal element. Thus, despite each thermal element in the group being one of the selected thermal elements, the thermal elements are counted when determining the packed thermal element number because they are also adjacent thermal elements.

For example, referring to FIG. 11, the thermal element associated with site $A_w$ is both a selected thermal element, as well as an adjacent thermal element, to the thermal element associated with site $A_x$. Also, the thermal element associated with site $A_x$ is both a selected thermal element, as well as an adjacent thermal element, to each of the thermal elements associated with sites $A_w$ and $A_y$. Using the example illustrated in FIG. 11, the packed thermal element number is fourteen. The number fourteen represents the sum of six sites in the current raster line, four sites in the previous raster line, and four sites in the two-back raster line.

Figure 12:
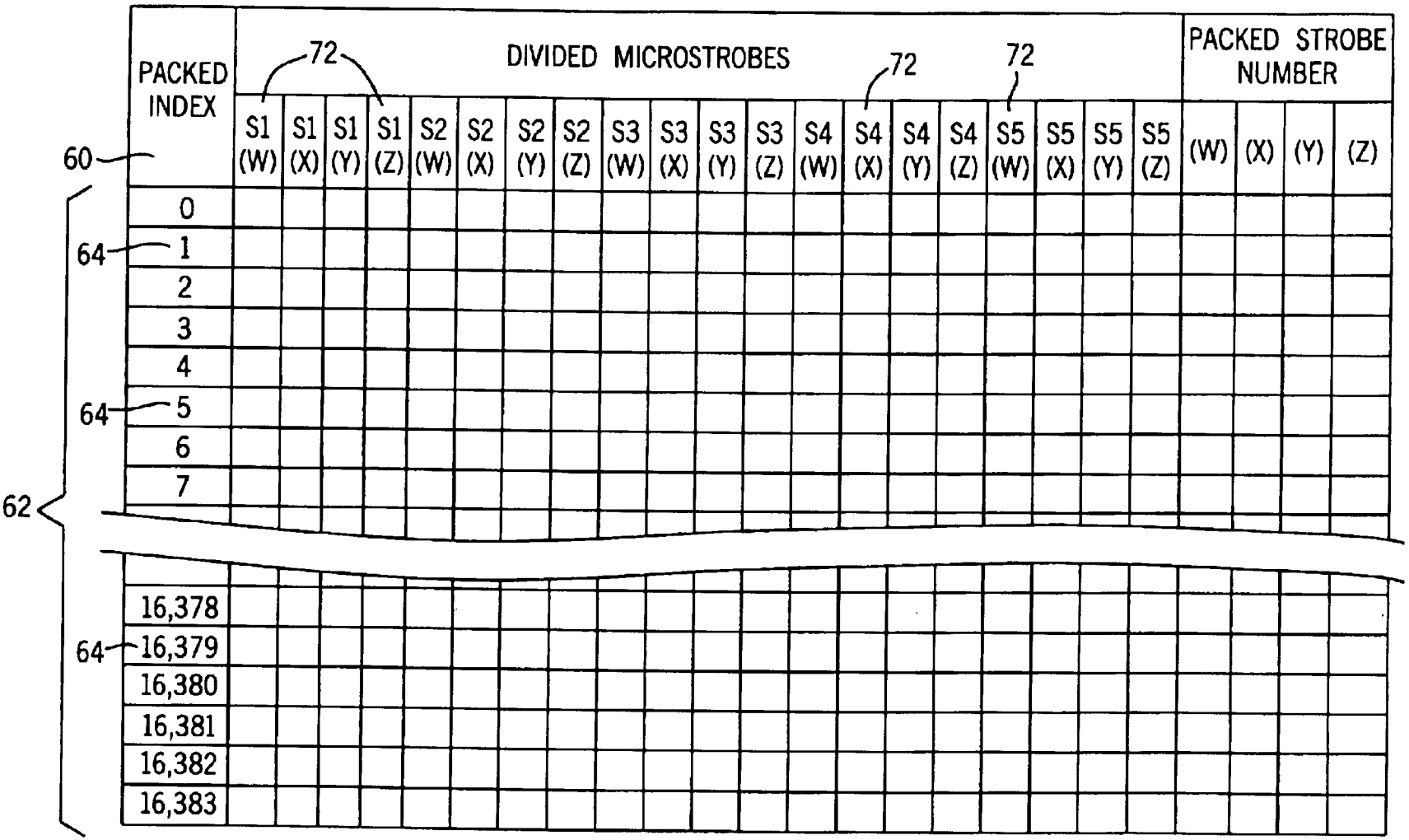
FIG. 12 illustrates, in one embodiment of the invention, a partially completed multiple thermal element organizational table comprising packed index values, based on the packed dot history pattern of FIG. 11, occupying a packed index length.

After determining the packed thermal element number, a packed index 60 having a packed index length 62, as illustrated (partially) in FIG. 12, can be generated by the processor. Because of space limitations, not all of packed index length 62 is shown in FIG. 12. Where the multiple thermal element organizational table of FIG. 12 has been truncated, a series of asterisks has been inserted.

In preferred embodiments, packed index length 62 corresponds to the number of rows used in the table of FIG. 12. Like the method used for the single thermal element described above, a packed index length 62 is based, at least in part, on the packed thermal element number. In preferred embodiments, packed index length 62 is also based on whether energy is delivered to each of the thermal elements in the group by the microcontroller. As such, there are two possible energy value combinations for each of the thermal elements in the group in the packed dot history pattern 58 (i.e., either each thermal element in the group receives energy or it does not). Having determined the packed thermal element number, packed index length 62 can be calculated based on the packed thermal element number and the number of possible energy value combinations (e.g., two (2) for a thermal element). In a preferred embodiment of the invention, packed index length 62 is calculated using the formula:

$$\text{Packed Index length} = (\text{number of possible energy value combinations})^{\textit{packed thermal element number}}$$

Here, packed index length 62 is the number of possible energy value combinations raised to the packed thermal element number power.

Using the packed dot history pattern of FIG. 11 as an example, there are again two possible energy value combinations. Also, the packed thermal element number from FIG. 11 is fourteen. Inserting those values into the packed index length formula of the preferred embodiment (see above) yields a packed index length of $2^{14}$, or sixteen thousand three hundred eighty-four (16,384). As illustrated (partially)

in FIG. 12, packed index length 62 correspondingly has sixteen thousand three hundred eighty-four values (represented by the numbers 0 to 16,383 in packed index 60).

After packed index length 62 is established, packed index values 64 can be generated to occupy packed index 60 over the entire packed index length 62. As the names suggest, packed index 60 and packed index values 64 can be used to arrange and assemble corresponding values of data in an organized manner as illustrated in FIG. 12. In preferred embodiments, packed index values 64 can represent one or more of the possible combinations of the intermittently fired group of thermal elements with the packed dot history pattern. Packed index values 64 are based on the packed dot history pattern 58 that was determined above.

Now that a packed index length 62 of sixteen thousand three hundred eighty-four has been produced using packed dot history pattern 58 of FIG. 11, packed index values 64 that correspond to the packed index length can be determined. Packed index values 64 can be generated in a variety of ways. In one preferred embodiment, packed index values 64 are calculated by assigning binary numbers (e.g., a 1 or a 0) to each of the sites (e.g., $B_{left}$, $A_w$, $A_x$, $A_y$, $A_z$, $B_{right}$, $C_w$, $C_x$, $C_y$, $C_z$, $E_w$, $E_x$, $E_y$, $E_z$) in the current, previous, and two-back packed burn patterns 66, 68, 70, respectively, as illustrated in FIG. 11.

If a thermal element generates a dot at one or more of sites $B_{left}$, $A_w$, $A_x$, $A_y$, $A_z$, $B_{right}$, $C_w$, $C_x$, $C_y$, $C_z$ and/or $E_w$, $E_x$, $E_y$, $E_z$, then a 1 is assigned to those sites. In other words, a 1 represents that the thermal element is ON and receives energy. If, however, a thermal element does not generate a dot at one or more of the sites, a 0 is assigned to those sites. In other words, a 0 represents that the thermal element is OFF and either does not receive energy, or received an insufficient level of energy for generating a dot. In one preferred embodiment, the binary numbers are inserting into the following formula:

$$\text{Packed index value}=B_{left}+(2\times A_w)+(4\times A_x)+(8\times A_y)+(16\times A_z)+(32\times B_{right})+(64\times C_w)+(128\times C_x)+(256\times C_y)+(512\times C_z)+(1{,}024\times E_w)+(2{,}048\times E_x)+(4{,}096\times E_y)+(8{,}192\times E_z)$$

By using the packed index value formula above, the sites associated with thermal elements in the formula are consecutive (i.e., sequential, adjacent) sites. Using consecutive sites in the packed index formula can aid in increasing the speed at which the processor operates.

Using the packed index value formula by inserting the assigned binary numbers, a series of consecutive numbers from 0 to 16,383 can be generated for the packed dot history pattern 58. These consecutive numbers represent packed index values 64, which are arranged in sequential order from smallest to largest, as partially illustrated in FIG. 12.

Once packed index values 64 have been determined, the processor uses the microstrobe number, representing the quantity of microstrobes 36, to augment the multiple thermal element organizational table of FIG. 12. The microstrobe number is one of the supply specific printing parameters that was previously accessed by the processor and stored in printer memory. A microstrobe number of five is employed for purposes of illustration.

As FIG. 12 shows, each of the microstrobes 36, which were originally labeled as S1, S2, S3, S4, and S5 (FIG. 5), are divided into four parts, one part for each of the thermal elements (W, X, Y, and Z) in the group of thermal elements. These parts of microstrobes 36 are known as divided microstrobes 72. As illustrated in FIG. 12, divided microstrobes 72 are labeled as S1(W), S1(X), S1(Y), S1(Z), S2(W), S2(X), S2(Y), S2(Z), S3(W), S3(X), S3(Y), S3(Z), S4(W), S4(X), S4(Y), S4(Z), S5(W), S5(X), S5(Y), and S5 (Z). In preferred embodiments, divided microstrobes 72 are arranged as shown within the packed organizational table of FIG. 12.

Next, packed binary pulse numbers 74, as illustrated in FIG. 13, are assigned to the divided microstrobes 72. If a packed binary pulse number 72 of 1 is assigned to a divided microstrobe, then a pulse of energy is delivered to a thermal element at that time. In other words, a 1 represents that the divided microstrobe 72 is ON and the divided microstrobe receives energy. If a packed binary pulse number 72 of 0 is assigned to a divided microstrobe, then no pulse of energy is delivered to the thermal element at that time. In other words, a 0 represents that the thermal element is OFF and the divided microstrobe does not receive energy.

To make the determination of whether to assign a 1 or a 0 to a particular divided microstrobe 72, a microstrobe pattern is selected. Previously, a suitable microstrobe pattern for a single thermal element was described. This suitable microstrobe pattern can also be used when processing the group of thermal elements. Based on the microstrobe pattern chosen, packed binary pulse numbers 74 are assigned to each of the divided microstrobes 72 for each packed index value 64, until packed index length 62 in FIG. 13 is fully occupied.

After packed binary pulse numbers 74 have been assigned, packed strobe numbers 76 can be calculated. Packed strobe numbers 76 represent particular configurations of divided microstrobes 72. The different configurations are used to preheat each of the thermal elements and/or generate printed dots using the thermal elements. The packed strobe number 76 for each thermal element in the group generally corresponds to a packed index value 64 in the packed index 60 as illustrated in FIG. 14. In a preferred embodiment, packed strobe numbers 76 corresponding to each packed index value 64 are calculated for each of the thermal elements in the group by inserting the assigned packed binary pulse numbers 74 for each of the divided microstrobes 72 into the following formula:

$$\text{Packed strobe number}(MTE)=S1(MTE)+(2\times S2(MTE))+(4\times S3(MTE))+(8\times S4(MTE))+(16\times S5(MTE))$$

The acronym MTE stands for multiple thermal element and, as used within the packed strobe number formula, represents a chosen thermal element within the group of thermal elements (e.g., W, X, Y, or Z). For example, if thermal element W were chosen, the packed strobe number formula would be:

$$\text{Packed strobe number}(W)=S1(W)+(2\times S2(W))+(4\times S3(W))+(8\times S4(W)+(16\times S5(W))$$

Thus, for each packed index value 64 in FIG. 14, a packed strobe number 76 for each of the thermal elements in the group can be calculated and arranged using the packed binary pulse numbers 74 assigned to divided microstrobes 72. As such, in the example using four thermal elements in the group, each packed index value 64 will correspond with four packed strobe numbers, one for each of the thermal elements in the group (e.g., (W), (X), (Y), and (Z)).

Figure 15:
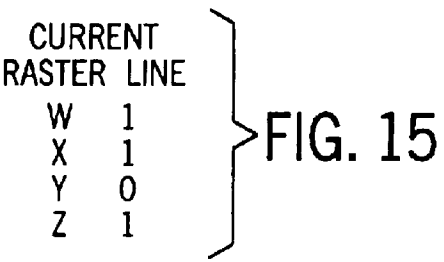
FIG. 15 illustrates, in one embodiment of the invention, the group of thermal elements associated with corresponding values of bit map pattern data that is used, in conjunction with table of FIG. 14, to generate a portion of a printed image.

At this point in the method, the multiple thermal element organizational table of FIG. 14 is completed and can be stored in the printer memory. As such, the processor associated with the printer can access the table from the printer memory and use the table to generate the printed image. To commence printing using the table of FIG. 14, the processor first accesses a bit map pattern (not shown). The bit map pattern is also sometimes referred to as bit map information, an image bit map, and the like. The bit map pattern, typically stored within printer memory, comprises numerous ones and zeros, known as values of bit map pattern data, which signal an instruction to print or not print, respectively. Using the example where the number of thermal elements in the group being simultaneously considered was four, the processor correspondingly examines the first four values from the bit map pattern data within the first raster line of the bit map pattern. In preferred embodiments, the processor aligns the first four values of bit map pattern data (i.e., the ones and zeros) with the group of thermal elements W, X, Y, and Z. For example, if the first four values of bit map pattern data were 1, 1, 0, and 1, then the group of thermal elements W, X, Y, and Z would be associated therewith as illustrated in FIG. 15.

After the first four values of bit map pattern data are retrieved from printer memory, the packed dot history pattern 58 of FIG. 11, which is also stored in printer memory, is used to calculate printing instructions. The first four values of bit map pattern data are placed in the packed dot history pattern 58 corresponding to the selected thermal element, which in the examples given, would comprise the group W, X, Y, and Z. Where the first four values of data are 1, 1, 0, and 1, referring to FIGS. 11 and 15, $A_w$ would comprise a 1, $A_x$ would comprise a 1, $A_y$ would comprise a 0, and $A_z$ would comprise a 1. However, the remaining sites in packed dot history pattern need to be filled for processing. To fill the remaining sites in packed dot history pattern 58, the dot history patterns and the bit map pattern stored in memory are each used.

For example, if the first four values of bit map pattern data from the printed image are accessed, there are no dot history patterns stored in printer memory. This is because the first four values of data, which will generate the first packed dot history pattern, are being used. Therefore, all the sites in the previous and two-back raster lines, as illustrated in FIG. 11, will be assigned a zero. Thus, $C_w$, $C_x$, $C_y$, $C_z$, $E_w$, $E_x$, $E_y$, and $E_z$ will all comprise a zero. Also, since the first four piece of bit map pattern data are being processed, $B_{left}$ and $B_{right}$ will also be zero. There is no adjacent thermal element that has fired. However, each of the thermal elements in the group, besides the selected thermal elements, being assigned a zero will not always be the case.

If other values of bit map pattern data from the printed image are accessed, dot history pattern 58 can comprise a very different configuration. For example, if the thermal elements associated with $B_{left}$, $C_w$, $C_x$, and $E_y$ are the only thermal elements that generated a dot, the processor, which has accessed the dot history patterns and bit map pattern from memory, will be alerted and assign a one to those thermal elements. The rest of the thermal elements proximate the sites in FIG. 11 are assigned a 0. By consulting the prior dot history patterns and the bit map pattern, the processor is able to complete dot history pattern 58 corresponding to the four values of bit map pattern data being processed. With all sites in the packed dot history pattern 58 of FIG. 11 assigned with a 1 or 0 for each of the selected thermal elements, adjacent thermal elements, and prior-generation thermal elements, the packed dot history pattern is completed. Thus, the packed index value formula described above is employed and, as a result, a packed index value 64 is calculated.

With the packed index value 64 that has just been calculated, the processor consults the multi thermal element organizational table of FIG. 14 previously stored in printer memory. The processor uses the packed index value 64 just calculated to find corresponding packed strobe numbers 76 associated with the packed index value. The table of FIG. 14 provides, using the example of four thermal elements in the group, four packed strobe numbers 76 (e.g., (W), (X), (Y), and (Z)), one packed strobe number for each of the thermal elements (W, X, Y, and Z) assigned to the group. The processor then stores the four packed strobe numbers 76 corresponding to W, X, Y, and Z into printer memory.

After having determined packed strobe numbers 76, the processor next consults the bit map pattern to determine if further dots and/or unprinted areas need to be printed (i.e., unprocessed values of bit map pattern data remain) to complete an entire raster line. If further dots and/or unprinted areas remain in the raster line, the processor selects a new group of thermal elements and the process of ascertaining packed strobe numbers 76 is repeated. Typically, when repeating the process, the thermal elements comprising the next group of thermal elements are the thermal elements that sequentially follow the thermal elements just processed. As such, groups of thermal elements are preferably sequentially processed until packed strobe numbers 76 are calculated and stored within printer memory for the entire raster line.

In those instances where four thermal elements are considered as a group, the process of determining packed strobe numbers 76 would be repeated three hundred and twelve times since an entire raster line comprises twelve hundred forty-eight printed and/or unprinted sites (1248/4=312). Depending on the number of thermal elements within the group, and the number of sites within a raster line, the number of iteration of multiple thermal element processing can vary.

In preferred embodiments, once the processor has an entire raster line of packed strobe numbers 76 stored in printer memory, the processor uses the microstrobe energy values 54 accessed from the memory associated with the supply (e.g., ribbon cartridge) and the entire raster line is printed by sequentially arranging the groups of stored packed strobe numbers. After the entire raster line is printed, the processor starts over with a new raster line. The processor continues to determine packed strobe numbers 76, using the method of grouping and simultaneously considering thermal elements, until each raster line comprising the printed image has been printed. The method of simultaneously processing the group of thermal elements to generate packed printing instructions can be generally referred to as a processor using a fast algorithm.

By simultaneously considering the group of thermal elements packed into the determined dot history pattern, the processor within printer 2 is able to generate printing instructions, using the fast algorithm method, more quickly and efficiently.

While the invention herein is generally directed to a thermal printing process, embodiments of the present invention can include, but are not limited to, a thermal wax transfer process, a thermal dye diffusion process, or a direct thermal transfer process. In the direct thermal transfer embodiment, no ribbon, or accompanying ribbon delivery and take up roller, is used. The thermal printhead presses directly against a thermally reactive media while the platen roller rotates to drive the media past the thermal printhead. Also, embodiments of the invention can include, but are not limited to, other types of printing, including non-thermal printing.

Despite the above method being outlined in a step-by-step sequence, the completion of the acts or steps in a particular chronological order is not mandatory. Further, elimination, modification, rearrangement, combination, reordering, or the like, of the acts or steps is contemplated and considered within the scope of the description and claims.

While the present invention has been described in terms of the preferred embodiment, it is recognized that equivalents, alternatives, and modifications, aside from those expressly stated, are possible and within the scope of the appending claims.

What is claimed is:

1. A method of processing a thermal element group to create a printed image, the method comprising:

providing printing parameters for a supply by providing a microstrobe number and microstrobe energy values, selecting a plurality of thermal elements to make up a selected thermal element group;

determining a dot history pattern, the dot history pattern based on the selected thermal element group made up of the plurality of thermal elements;

determining a thermal element number;

generating a packed table, the packed table comprising values based on the supply printing parameters, selected thermal element group, the dot history pattern, and the thermal element number; and storing the packed table in a printer memory for use in creating a printed image.

2. The method of claim 1, wherein the providing the printing parameters step includes providing the printing parameters using a memory cell associated with the supply.

3. The method of claim 1, wherein the determining the dot history pattern step comprises determining adjacent thermal elements by determining a plurality of sites associated with the thermal elements adjacent the selected thermal elements.

4. The method of claim 3, wherein the determining the dot history pattern step comprises determining prior generation adjacent thermal elements by determining a plurality of sites associated with the prior generation of the adjacent thermal elements.

5. The method of claim 1, wherein the determining the dot history pattern step comprises determining prior generation selected thermal elements by determining a plurality of sites associated with the prior generation of the selected thermal elements.

6. The method of claim 1, further comprising determining an index length based on the thermal element number.

7. The method of claim 1, further comprising determining a plurality of index values based on the determined dot history pattern.

8. The method of claim 1, further comprising determining a total energy value based on an amount of energy needed for pre-heating each thermal element.

9. The method of claim 1, further comprising determining the packed table based on a number of possible energy value combinations and a packed thermal element number.

10. The method of claim 1, further comprising determining an index length such that the length equals a number of possible energy value combinations for each of the plurality of thermal elements raised to a power equal to the thermal element number.

11. The method of claim 10, wherein the selecting a plurality of thermal elements step includes selecting at least one of a plurality of consecutive thermal elements, sequential thermal elements, and adjacent thermal elements.

12. A method of processing a thermal element group to create a printed image, the method comprising:

accessing, from a specific supply, printing parameters comprising a microstrobe number and microstrobe energy values and storing the microstrobe number and microstrobe energy values in a primer memory;

determining a dot history pattern;

determining a number of thermal elements for the thermal element group;

assigning thermal elements to the thermal element group based on the number of thermal elements determined for the thermal element group;

packing the thermal element group into the dot history pattern to generate a packed dot history pattern;

determining a packed thermal element number based on the packed dot history pattern;

creating a packed index having a packed index length, the packed index length based on the packed thermal element number, and determining packed index values to occupy the packed index length, the packed index values based on the packed dot history pattern;

dividing microstrobes, the microstrobes based on the microstrobe number stored in the printer memory, such that divided microstrobes are produced;

assigning packed binary pulse numbers to the divided microstrobes based on a strobe pattern, the packed binary pulse numbers corresponding to each of the packed index values occupying the packed index length;

determining packed strobe numbers based on the packed binary pulse numbers, the packed strobe numbers corresponding to each of the packed index values occupying the packed index length;

wherein the printed image is created by using a bit map pattern, the packed dot history pattern, the packed index values, the packed strobe numbers, and the microstrobe energy values.

13. The method of claim 12, further comprising storing one or more of the bit map pattern, the packed dot history pattern, the packed index values, and the packed strobe numbers in a printer memory.

14. The method of claim 12, further comprising loading a cartridge containing a supply of ribbon and containing the printing parameter into a printer.

15. The method of claim 14, further comprising storing the printing parameters in a memory cell secured to the cartridge.

16. The method of claim 15, further comprising erasing the memory cell after exhausting the supply of ribbon contained within the cartridge.

17. The method of claim 15, further comprising unlocking an electronic lock in the memory cell with an electronic key associated with the printer.

18. The method of claim 17, further comprising accessing the electronic key and unlocking, using the key, the supply specific printing parameters stored in the memory cell.

19. The method of claim 15, further comprising selecting the memory cell from one of a group consisting of a solid-state memory device, a RAM, a non-volatile RAM, an EEPROM, and a flash memory.

20. The method of claim 15, further comprising providing an ergonomically designed supply cartridge.

21. The method of claim 12, wherein the assigning step further comprises assigning consecutive thermal elements.

22. A method of processing a thermal element group to create a printed image, the method comprising:

accessing, from a specific supply, printing parameters comprising a microstrobe number and microstrobe energy values and storing the microstrobe number and microstrobe energy values in a printer memory;

determining a dot history pattern;

determining a number of thermal elements for the thermal element group;

assigning thermal elements to the thermal element group based on the number of thermal elements determined for the thermal element group;

packing the thermal element group into the dot history pattern to generate a packed dot history pattern;

determining a packed thermal element number based on the packed dot history pattern;

creating a packed index having a packed index length, the packed index length based on the packed thermal element number, and determining packed index values to occupy the packed index length, the packed index values based on the packed dot history pattern;

dividing microstrobes, the microstrobes based on the microstrobe number stored in the printer memory, such that divided microstrobes are produced;

assigning packed binary pulse numbers to the divided microstrobes based on a strobe pattern, the packed binary pulse numbers corresponding to each of the packed index values occupying the packed index length;

determining packed strobe numbers based on the packed binary pulse numbers, the packed strobe numbers corresponding to each of the packed index values occupying the packed index length, until an entire raster line of packed strobe numbers is ascertained;

wherein the printed image is created by using a bit map pattern, the packed dot history pattern, the packed index values, the entire raster lines of the packed strobe numbers, and the microstrobe energy values.

23. The method of claim 22, further comprising storing one or more of the bit map pattern, the packed dot history pattern, the packed index values, and the entire raster lines of the packed strobe numbers in printer memory.

24. The method of claim 22, further comprising creating the printed image after two or more of the entire raster lines have been printed.

25. The method of claim 22, wherein the method further comprises:

using a component to aid in processing, the component selected from a group consisting of a keyboard, a mouse, an operator, a liquid crystal display, and a monitor.

26. The method of claim 22, wherein creating the printed image includes using the bit map pattern, and the bit map pattern comprises values of bit map pattern data.

27. The method of claim 26, further comprising representing the bit map pattern data as a plurality of ones and zeros.

28. The method of claim 27, further comprising providing an instruction, based on the representing of the bit map pattern data, to either generate a dot or not generate a dot.

* * * * *